US011478077B2

(12) United States Patent
George et al.

(10) Patent No.: US 11,478,077 B2
(45) Date of Patent: Oct. 25, 2022

(54) CABINET

(71) Applicant: Robern, Inc., Bristol, PA (US)

(72) Inventors: Devon George, Wyncote, PA (US); Jason Mort, Spring City, PA (US); George Wahlgren, Medford Lakes, NJ (US); Linda Yang, Plymouth Meeting, PA (US)

(73) Assignee: Robern, Inc.

( * ) Notice: Subject to any disclaimer, the term of this patent is extended or adjusted under 35 U.S.C. 154(b) by 0 days.

(21) Appl. No.: 17/314,737

(22) Filed: May 7, 2021

(65) Prior Publication Data

US 2021/0259407 A1 Aug. 26, 2021

Related U.S. Application Data

(63) Continuation of application No. 16/703,127, filed on Dec. 4, 2019, now Pat. No. 11,026,507.

(51) Int. Cl.
*A47B 46/00* (2006.01)
*A47B 67/02* (2006.01)

(52) U.S. Cl.
CPC ..... *A47B 46/00* (2013.01); *A47B 67/02* (2013.01)

(58) Field of Classification Search
CPC ..... A47B 46/00; A47B 67/02
USPC ..... 312/300, 302, 309, 310, 321.5, 271, 227
See application file for complete search history.

(56) References Cited

U.S. PATENT DOCUMENTS 303,783 A * 8/1884 Zimmerman
1,209,080 A * 12/1916 Tower ..... F25D 23/087 312/405.1
1,284,492 A * 11/1918 Thomas ..... F21V 33/00 49/70
1,996,767 A 4/1935 Hunter
2,199,731 A 5/1940 Pryne
2,575,567 A * 11/1951 Swartz ..... A47B 49/004 312/304
2,692,813 A 10/1954 Toronto
2,761,751 A * 9/1956 Stockton ..... F25D 25/024 312/274
2,911,275 A 11/1959 Wise
(Continued)

FOREIGN PATENT DOCUMENTS

CN 203244313 U 10/2013
CN 104116446 A 10/2014
(Continued)

OTHER PUBLICATIONS

First Chinese Office Action 202011405257.7 dated Jan. 24, 2022.

*Primary Examiner* — James O Hansen
(74) *Attorney, Agent, or Firm* — The Belles Group, P.C.

(57) ABSTRACT

A cabinet including a housing having a cavity, a door that closes a front opening of the cavity, and a storage device. The storage device may include a movable storage member that is movable relative to the housing between a first position within the cavity and a second position outside of the cavity. The movable storage member may be configured to be coupled to the housing at a plurality of different locations. The storage device may be coupled directly to an inner surface of a sidewall of the housing that defines the cavity. The storage device may also include a fixed storage member that is non-movably coupled to the housing such that the movable storage member is pivotable relative to the housing and relative to the fixed storage member.

16 Claims, 13 Drawing Sheets

(56) References Cited

U.S. PATENT DOCUMENTS

| | | | | | |
|---|---|---|---|---|---|
| 2,950,946 | A | | 8/1960 | Starworth | |
| 2,963,171 | A | | 12/1960 | Johnson | |
| 3,070,340 | A | | 12/1962 | Cohn | |
| 3,172,715 | A | | 3/1965 | Powder | |
| 4,087,140 | A | | 5/1978 | Linstromberg | |
| 4,269,039 | A | | 5/1981 | Baker | |
| 4,309,065 | A | | 1/1982 | Pappas | |
| 4,739,577 | A | * | 4/1988 | Lanius | B25H 3/023 43/57.1 |
| 4,740,044 | A | * | 4/1988 | Taylor | A47B 21/03 312/196 |
| 5,164,861 | A | | 11/1992 | Katz | |
| 5,269,599 | A | | 12/1993 | Moring | |
| 5,810,462 | A | | 9/1998 | Lee | |
| 6,045,105 | A | | 4/2000 | Katz | |
| 6,349,999 | B1 | | 2/2002 | Takahashi et al. | |
| 8,517,478 | B2 | * | 8/2013 | Diemel | F25D 11/00 312/401 |
| 9,211,004 | B2 | | 12/2015 | Diemel, Jr. et al. | |
| 9,339,151 | B2 | | 5/2016 | Yang et al. | |
| 2007/0215493 | A1 | | 9/2007 | Servis | |
| 2009/0015121 | A1 | * | 1/2009 | Sampson | A47B 67/02 109/58 |
| 2016/0331129 | A1 | | 11/2016 | Vanheusden et al. | |
| 2017/0290726 | A1 | | 10/2017 | Hovenden et al. | |

FOREIGN PATENT DOCUMENTS

| | | | |
|---|---|---|---|
| CN | 204814942 | U | 12/2015 |
| CN | 205458296 | U | 8/2016 |
| KR | 20-2009-0013043 | | 12/2009 |
| KR | 20-0479578 | | 2/2016 |

* cited by examiner

CABINET

CROSS-REFERENCE TO RELATED APPLICATIONS

The present application is a continuation of U.S. patent application Ser. No. 16/703,127, filed Dec. 4, 2019, the entirety of which is incorporated herein by reference.

BACKGROUND

Cabinets are used throughout the home and in certain office environments in order to store items out of sight but in an easily accessible location. For example, medicine cabinets are typically hung in a bathroom and include a mirrored door. People typically store items related to personal hygiene in these medicine cabinets, such as deodorant, toothpaste, toothbrushes, hairbrushes, and medication. Users may have to open the door to access a particular item, close the door in order to use the mirror on the front surface thereof, and then open the door again to replace the item back into the cabinet. There is a need for improvements in the cabinet space that provide a user with an increased accessibility to certain items and/or a place to store personal items off the countertop during personal hygiene activities

BRIEF SUMMARY

The present invention may be directed to a cabinet including a housing having a cavity, a door that closes a front opening of the cavity, and a storage device. The storage device may include a movable storage member that is movable relative to the housing between a first position within the cavity and a second position outside of the cavity. The movable storage member may be configured to be coupled to the housing at a plurality of different locations including at different elevations within the cavity. The storage device may be coupled directly to an inner surface of a sidewall of the housing that defines the cavity. The storage device may also include a fixed storage member that is non-movably coupled to the housing such that the movable storage member is pivotable relative to the housing and relative to the fixed storage member.

In one aspect, the invention may be a cabinet comprising: a housing comprising a cavity having a front opening; a door coupled to the housing and alterable between: (1) an open state whereby the front opening of the cavity is exposed to provide access to the cavity; and (2) a closed state whereby the door closes the front opening of the cavity; a storage device coupled to the housing, the storage device comprising a first storage member that is fixed relative to the housing and a second storage member that is movable relative to the first storage member and the housing between: (1) a first position whereby the first and second storage members of the storage device are located within the cavity of the housing; and (2) a second position whereby the first storage member is located within the cavity of the housing and the second storage member is located outside of the cavity of the housing; and wherein the door is able to be altered into the closed state when the second storage member is in either of the first or second positions.

In another aspect, the invention may be a cabinet comprising: a housing comprising a cavity defined by a rear wall and inner surfaces of one or more sidewalls extending from the rear wall to a front opening of the cavity; a door coupled to the housing and configured to close the front opening of the cavity; and a storage device coupled directly to the inner surface of one of the one or more sidewalls of the housing, the storage device comprising a movable storage member that is pivotable relative to the housing between a first position whereby the movable storage member is located within the cavity of the housing and a second position whereby the movable storage member is located outside of the cavity of the housing.

In yet another aspect, the invention may be a cabinet comprising: a housing comprising a cavity defined by a rear wall and inner surfaces of one or more sidewalls extending from the rear wall to a front opening of the cavity; a door coupled to the housing and configured to close the front opening of the cavity; a storage device coupled to the housing, the storage device comprising a movable storage member that is pivotable relative to the housing between a first position whereby the movable storage member is located within the cavity of the housing and a second position whereby the movable storage member is located outside of the cavity of the housing; and wherein the storage device is configured to be coupled to the inner surface of one of the one or more sidewalls of the housing at a plurality of different locations along the one of the one or more sidewalls.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
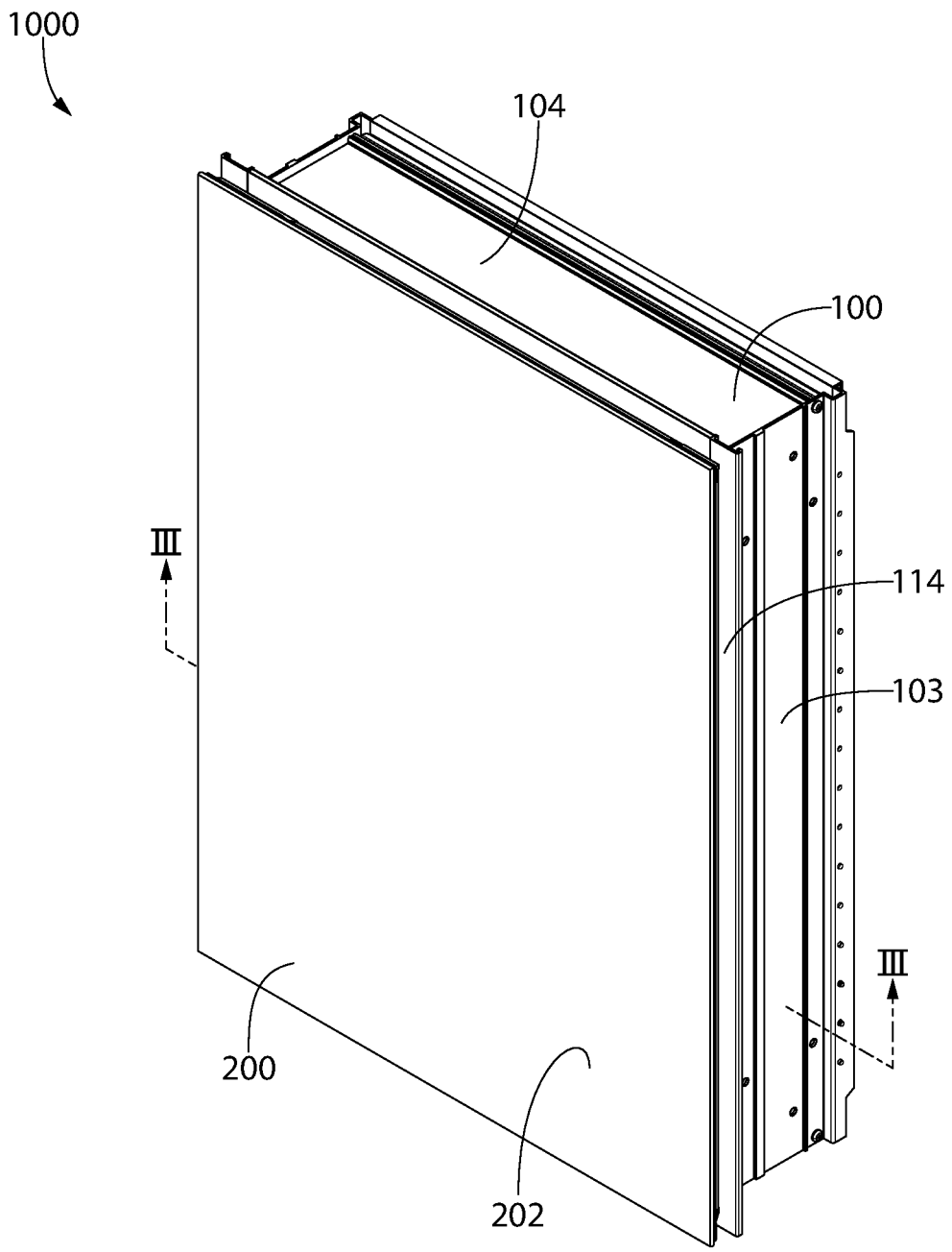
FIG. 1 is a perspective view of a cabinet including a housing and a door in accordance with an embodiment of the present invention, wherein the door is in a closed state.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
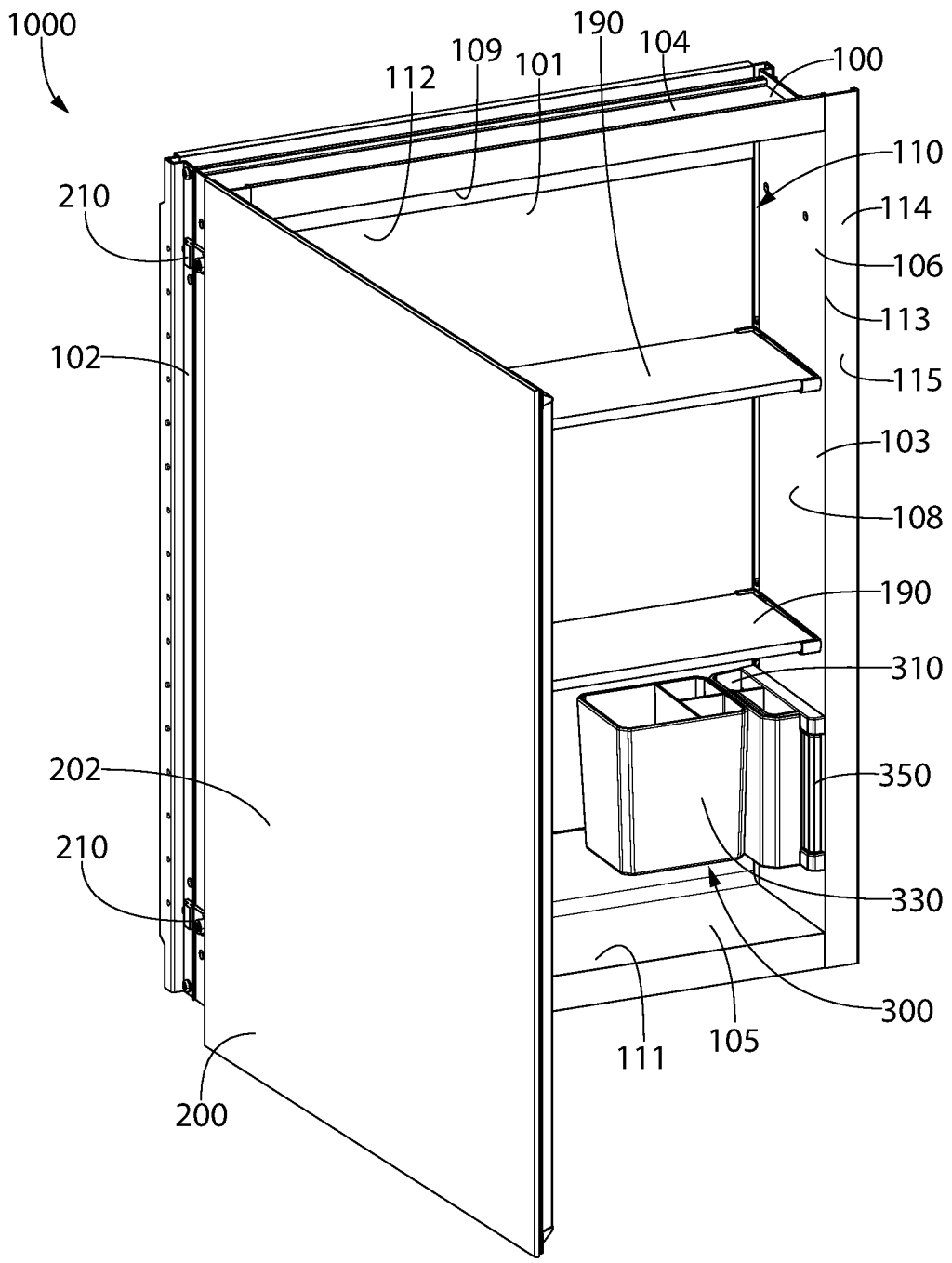
FIG. 2 is a perspective view of the cabinet of FIG. 1 with the door in an open state and illustrating a storage device coupled to the housing and located within a cavity of the housing.
Figure 3:
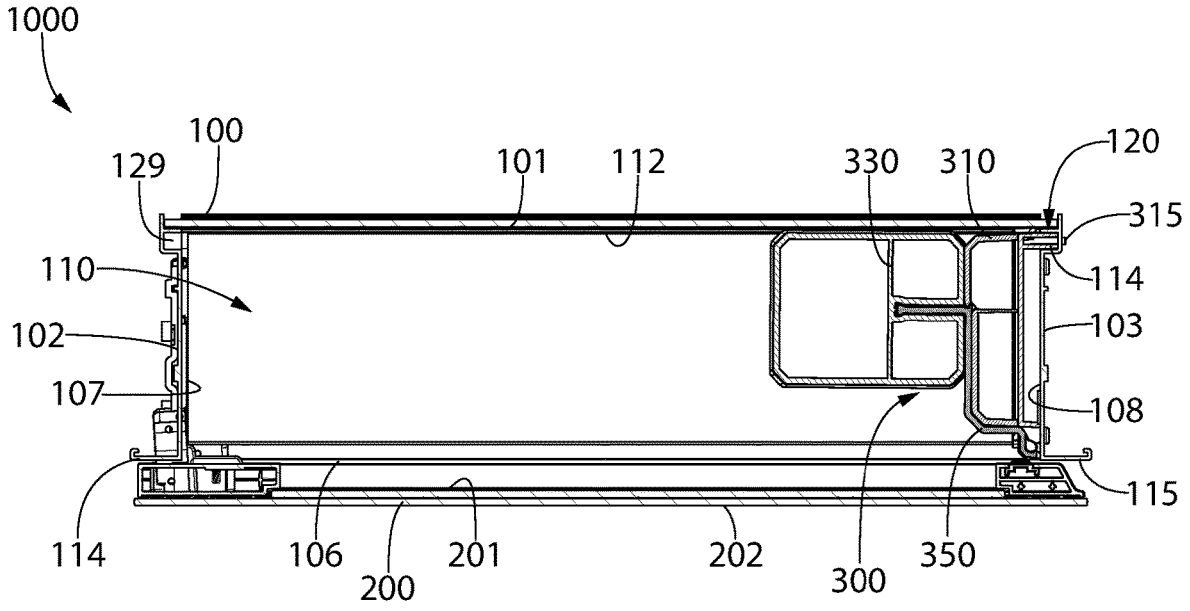
FIG. 3 is a cross-sectional view taken along line III-III of FIG. 1.

Referring to FIGS. 1-3, a cabinet 1000 is illustrated in accordance with an embodiment of the present invention. The cabinet 1000 generally comprises a housing 100, a door 200 coupled to the housing 100, and a storage device 300 coupled to the housing 100. The housing 100 comprises a cavity 110 within which various items may be stored. In the exemplified embodiment, the storage device 300 is coupled to the housing 100 and is located within the cavity 110. As will be described in detail herein, the storage device 300, or a portion thereof, is movable such that it can be positioned entirely within the cavity 110 or it can be altered so that at least a portion of the storage device 300 is located outside of the cavity 110. The purpose of this is to adjust the accessibility of certain items that may be stored in the storage device 300. The door 200 can be closed with the storage device 300 located entirely within the cavity 110 or with a portion of the storage device 300 located outside of the cavity 110. Thus, certain items stored in the storage device 300 may be accessible to a user even when the door 200 is closed.

The housing 100 may be formed from any material that is commonly or conventionally used to manufacture cabinets. Thus, for example, the housing 100 may be formed from metal, plastic, or wood in various different embodiments. The housing 100 may comprise a rear wall 101 and a plurality of sidewalls extending from the rear wall 101 to a front opening 106 of the cavity 110. In the exemplified embodiment, the plurality of sidewalls comprises a left sidewall 102, a right sidewall 103, a top sidewall 104, and a bottom sidewall 105. The left sidewall 102 has an inner surface 107, the right sidewall 103 has an inner surface 108, the top sidewall 104 has an inner surface 109, and the bottom sidewall 105 has an inner surface 111. Thus, in the exemplified embodiment the cavity 106 has a rectangular or square shape. However, different numbers of sidewalls may be used in other embodiments, which will in turn alter the shape of the cavity 106. For example, if there are three sidewalls the cavity may have a triangular shape, if there are six sidewalls the cavity may have a hexagonal shape, etc.

The inner surfaces 107, 108, 109, 111 of the plurality of sidewalls and a front surface 112 of the rear wall 101 collectively define the cavity 110. The plurality of sidewalls each extend from the front surface 112 of the rear wall 101 to the front opening 106 of the cavity 110. More specifically, each of the plurality of sidewalls extends from the rear wall 101 to a distal end or terminal end 113, with the distal end 113 surrounding the front opening 106 of the cavity 110. The front opening 106 of the cavity 110 may be coplanar with the distal ends 113 of the sidewalls. Furthermore, the housing 100 comprises a frame 114 which extends from the distal ends 113 of the plurality of sidewalls in a direction away from the cavity 110. In the exemplified embodiment, the frame 114 extends perpendicularly from the sidewalls 102, 103, 104, 105, but it could be oblique in other embodiments. The frame 114 forms a flange that surrounds the front opening 106 of the cavity 110. The frame 114 has a front surface 115 that interfaces with or faces an inner surface 201 of the door 200 when the door 200 is closed, as shown in FIG. 3.

In the exemplified embodiment, there are a plurality of shelves 190 extending horizontally within the cavity 110 from the left sidewall 102 to the right sidewall 103. Thus, in the exemplified embodiment the shelves 190 may be coupled to or supported by pins or other support members that are coupled to the left and right sidewalls 102, 103 of the housing 100. Although two shelves are shown in FIG. 2, more or less than two shelves could be used in other embodiments.

The door 200 is coupled to the housing 100 by one or more hinges 210 to permit the door 200 to be altered between the open and closed states. In the exemplified embodiment, the door 200 is hingedly coupled to the left sidewall 102 of the housing 100. However, the invention is not to be so limited in all embodiments and the door 200 could instead be hingedly coupled to the right sidewall 103 of the housing 100. The door 200 could also be hingedly coupled to the top or bottom sidewalls 104, 105 in other embodiments, although this would be a less traditional approach. Moreover, the door 200 could be a slidable door rather than one that pivots about a hinge relative to the housing 100. Thus, the door 200 could be coupled to the housing 100 in such a way so that the door 200 can slide leftwards, rightwards, upwards, or downwards to open and/or close the front opening 106 of the cavity 110.

Moreover, in some embodiments the coupling of the door 200 to the housing 100 may be interchangeable so that a user can decide whether to couple the door 200 to the left sidewall 102 or the right sidewall 104, which may be dictated by the location at which the cabinet 1000 is to be hung. Regardless of the specific manner in which the door 200 is coupled to the housing 100, the door 200 is alterable between: (1) an open state, as shown in FIG. 2, whereby the front opening 106 of the cavity 110 is exposed to provide access into the cavity 106; and (2) a closed state, as shown in FIG. 1, whereby the door 200 closes the front opening 106 of the cavity 110. Thus, when a user desires to gain access to items stored in the cavity 106 (such as on the shelves, on the bottom sidewall 105, or the like), the user will open the door 200 to expose the front opening 106. Upon removing or replacing the desired items from the cavity 110, the user will close the door 200.

The door 200 comprises the inner surface 201 which faces the cavity 110 when the door 200 is in the closed state and an outer surface 202. The outer surface 202 may be a mirrored surface in some embodiments. Thus, the outer surface 202 of the door 200 may be or comprise a mirror so that a user can see his/her reflection therein. Thus, a user may perform daily hygiene activities with the door 200 closed so that the user can see him or herself performing such daily hygiene activities. Of course, the outer surface 202 of the door 200 is not required to be a mirrored surface in all embodiments.

As mentioned above, the storage device 300 is coupled to the housing 100 and is located within the cavity 106 of the housing 100. More specifically, in the exemplified embodiment the storage device 300 is coupled to the inner surface 108 of the right sidewall 103. However, the invention is not to be so limited in all embodiments and the storage device 300 may be coupled to the inner surface of any one of the plurality of sidewalls in various different embodiments. However, in certain embodiments it may be preferred to couple the storage device 300 to either the inner surface 107 of the left sidewall 102 or the inner surface 108 of the right sidewall 103. Nonetheless, the storage device 300 could also be coupled to the inner surface 109 of the top sidewall 104 or the inner surface 111 of the bottom sidewall 105. In still other embodiments, it may be possible to couple the storage device 300 to the inner surface 201 of the door 200.

Figure 8A:
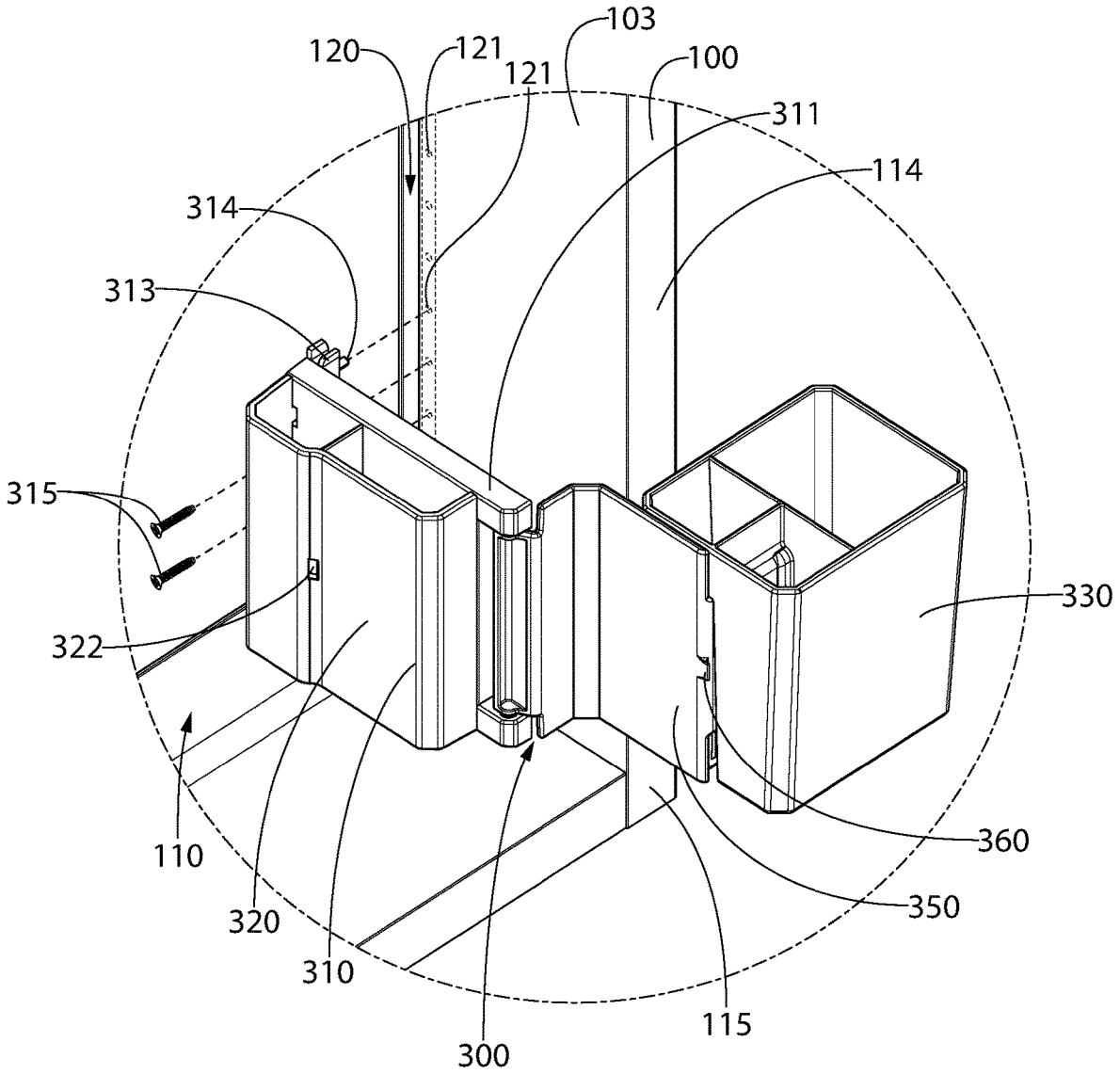
FIGS. 8A and 8B are close-up views of a portion of the cabinet of FIG. 2 illustrating a manner of coupling the storage device to the housing.
Figure 8B:
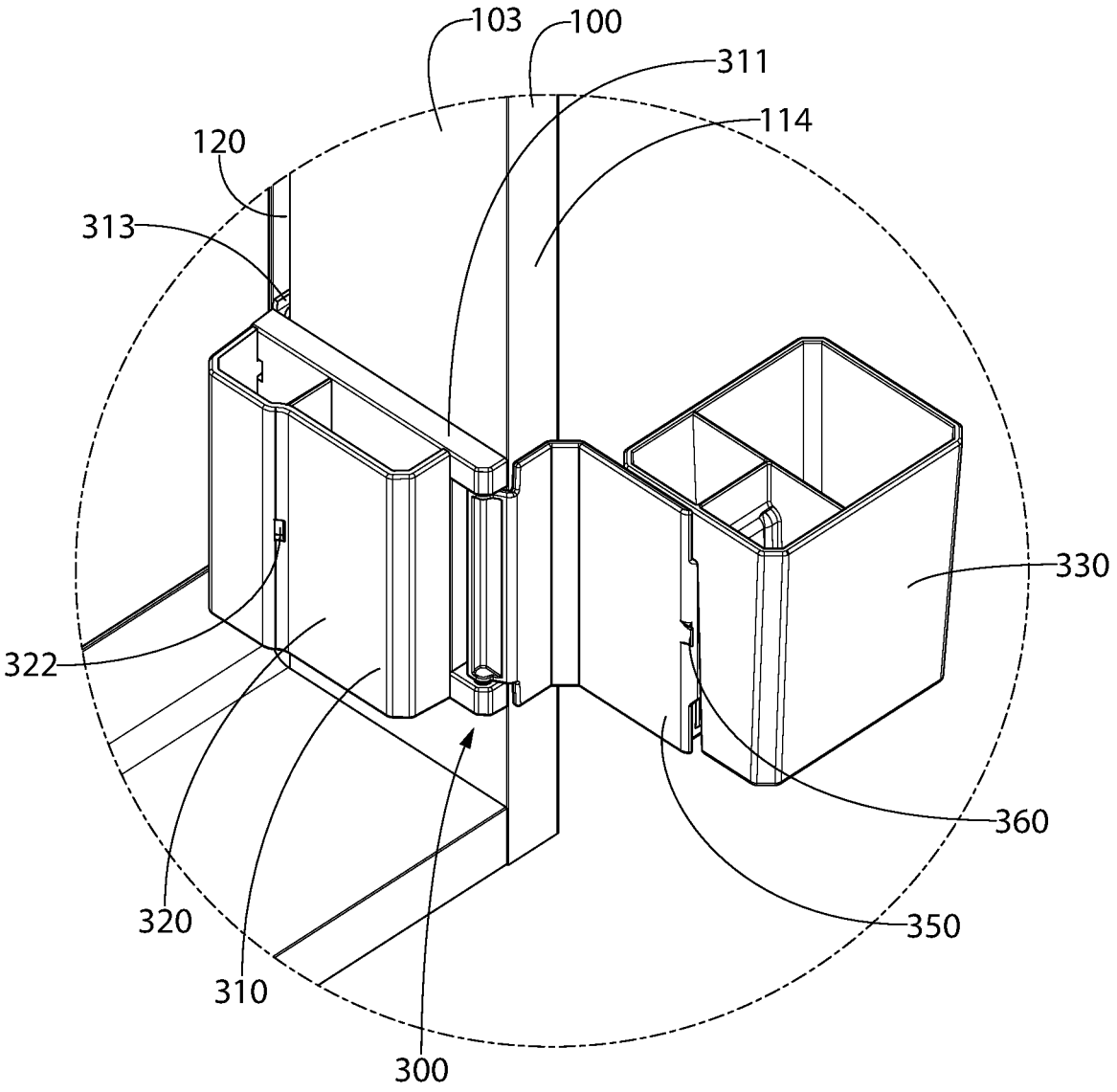
Figure 8C:
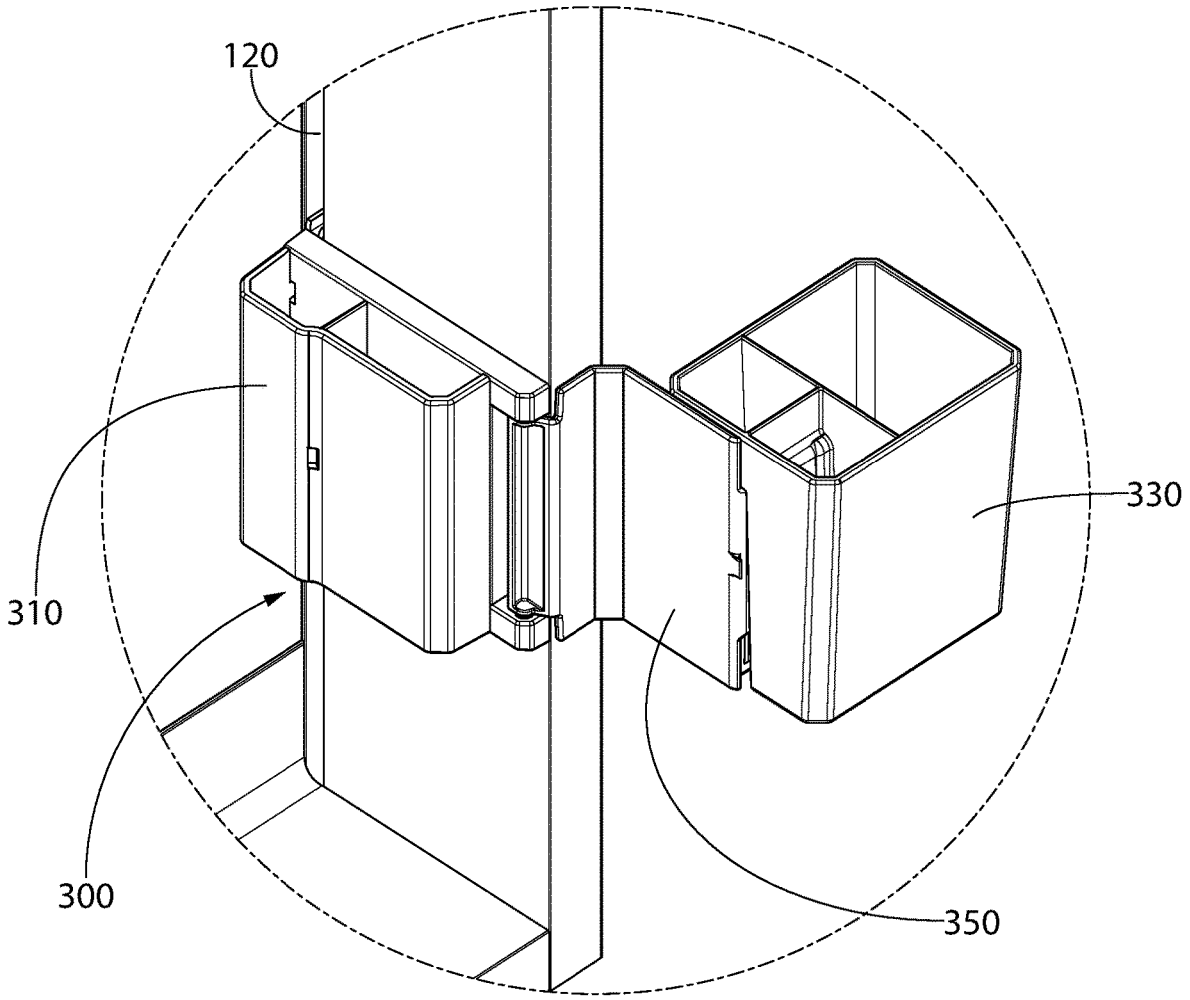
FIG. 8C is a close-up view of the portion of the cabinet of FIGS. 8A and 8B illustrating the storage device coupled to the housing at a different location along the housing.

Furthermore, as will be described in more detail below with particular reference to FIGS. 8B and 8C, the exact location at which the storage device 300 is coupled to the housing 100 may be modified by an end-user. Thus, the end user (or the manufacturer) may couple the storage device 300 to the housing 100 on any of the sidewalls thereof, and at any height or elevation within the cavity 106. Thus, although in FIG. 2 the storage device 300 is illustrated coupled to the right sidewall 103 near the bottom of the cavity, the storage device 300 could instead be coupled higher up along the right sidewall 103, such as between the two shelves 190, or between the upper shelf 190 and the top sidewall 104. Thus, the cabinet 1000 is modular in that the storage device 300 may be coupled to the housing 100 at various locations without departing from the invention described herein. The location of the shelves 190 may also be modifiable by attaching them to the housing 100 at different elevations within the cavity 110.

The storage device 300 generally comprises a first storage member 310, a second storage member 330, and a hinge 350 that couples the second storage member 330 to the first storage member 310. The first storage member 310 may be referred to herein as a fixed storage member in some embodiments. The second storage member 330 may be referred to herein as a movable storage member in some embodiments. In the exemplified embodiment, and as described in more detail below, the first storage member 310 is coupled to the housing 100 so as to be fixed or non-movable relative to the housing 100. Thus, the first storage member 310 may be coupled to the housing 100 so as to always be located within the cavity 106 of the housing 100. The second storage member 330 is movably coupled to the first storage member 310 so that the second storage member 300 can move (i.e., pivot or rotate) relative to the first storage member 310. More specifically, the second storage member 330 is movably coupled to the first storage member 310 by the hinge 350 and the hinge 350 permits the aforementioned movement of the second storage ember 330 relative to the first storage member 310 and relative to the housing 100. Details of the coupling of the storage device 300 to the housing 100 will be described in greater detail below with reference to FIGS. 3, 8A, and 8B.

In FIG. 3, the second storage member 330 of the storage device 300 is illustrated in a first position, whereby an entirety of the storage device 300 including the first storage member 310, the second storage member 330, and the hinge 350 is located within the cavity 110 of the housing 100. Thus, in the first position no portion of the storage device 300 protrudes through the front opening 106 of the cavity 110. The entire hinge 350, the entire first storage member 310, and the entire second storage member 330 are positioned in the cavity 110 when the second storage member 330 is in the first position. As will be described below, the second storage member 330 is alterable from the first position to a second position whereby the second storage member 330 is located outside of the cavity 110 of the housing 100 (see, for example, FIGS. 9-11).

Figure 4A:
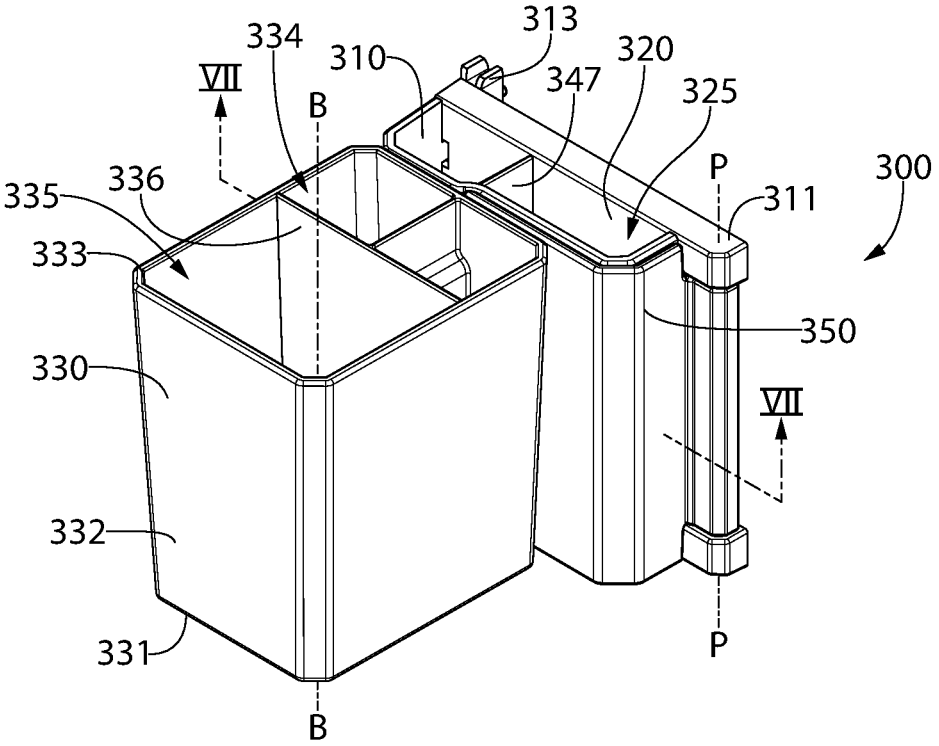
FIG. 4A is a front perspective view of the storage device shown in FIG. 2, with the storage device in a first position.
Figure 4B:
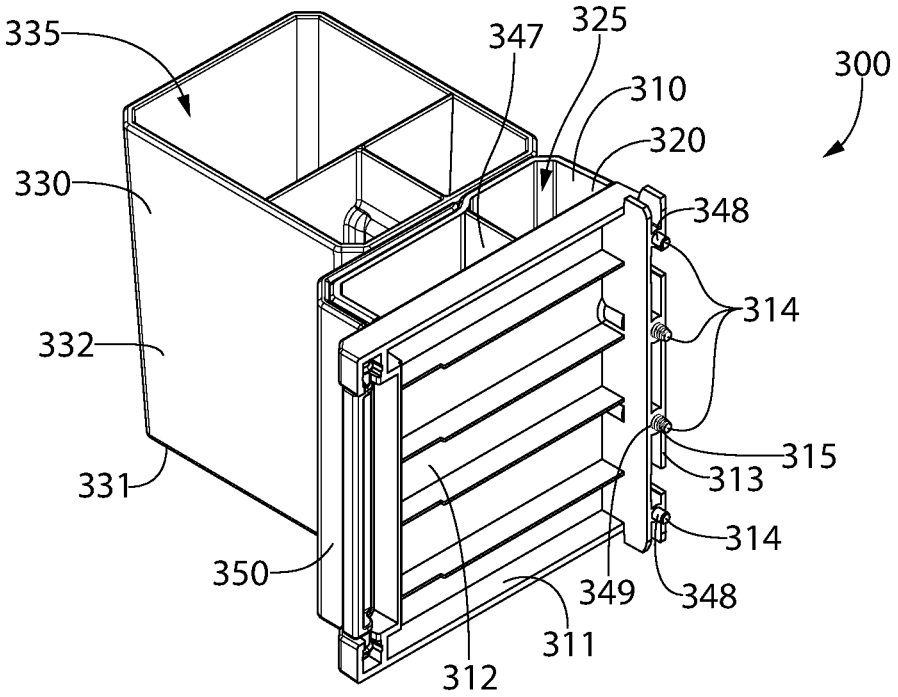
FIG. 4B is a rear perspective view of the storage device shown in FIG. 4A.
Figure 5:
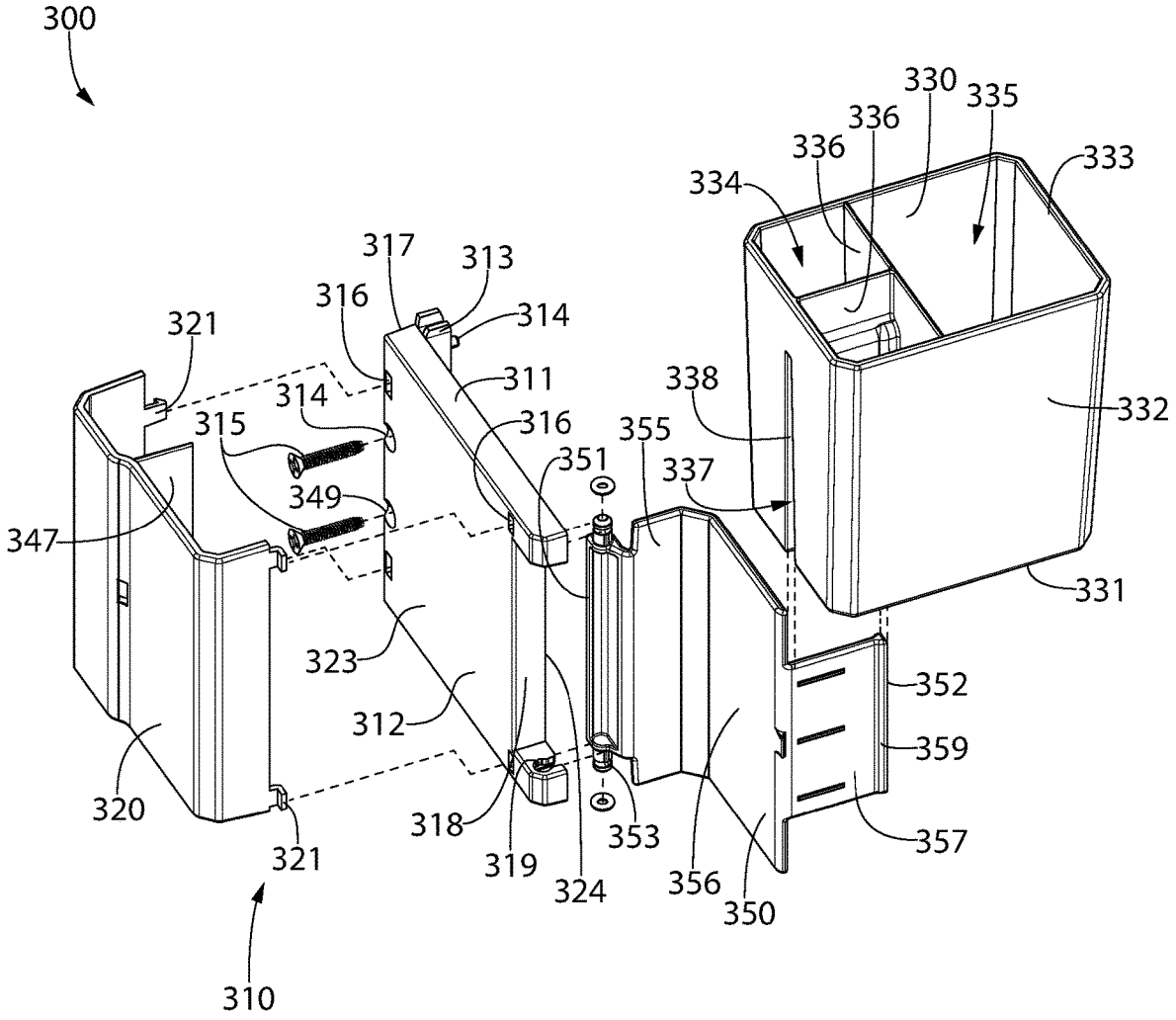
FIG. 5 is an exploded view of the storage device of FIGS. 4A and 4B.

Referring to FIGS. 4A, 4B, and 5, the storage device 300 will be further described. The storage device 300 may be formed from any desirable material. However, in the exemplified embodiment the storage device 300 is formed from a plastic material. In other embodiments, the storage device 300 could be formed from metal. In still other embodiments, some components of the storage device 300 could be formed from plastic (the first and second storage members 310, 330) whereas other components of the storage device 300 could be formed from metal (the hinge 350). Thus, variations in the material used to form the storage device 300 fall within the scope of the invention described herein.

As noted above, the storage device 300 generally comprises the first storage member 310, the second storage member 330, and the hinge 350 that couples the second storage member 330 to the first storage member 310. In the exemplified embodiment, each of the first and second storage members 310, 330 are containers having one or more compartments for storing items therein. However, the invention is not to be so limited in all embodiments and the first and second storage members 310, 330 can take on other structural forms in other embodiments. Thus, for example, one or both of the first and second storage members 310, 330 could be a shelf, a ledge, a receptacle, a bin, or any other device that is typically used for holding or otherwise supporting items for storage and/or display. Thus, for example, the first storage member 310 could be a container while the second storage member 330 could be a shelf in some embodiments. Thus, the term storage member should not be limited to containers as shown in the drawings, but should include any device or member that is or can be used for storage of an item (i.e., a toothbrush, floss, medication, a razor, a lotion, or even an electronic device such as a cellular phone). Stated again, as used herein the term storage member includes containers, receptacles, shelves, ledges, bins, or the like.

The first storage member 310 generally comprises a connection plate 311 which is configured to be coupled directly to one of the plurality of sidewalls of the housing 100 (or to the door 200) and a receptacle member 320. In the exemplified embodiment, the connection plate 311 comprises a plate portion 312 having a front surface 323 and a rear surface 324 opposite the front surface 323 and a connection portion 313 protruding from the rear surface 324 of the plate portion 312. The connection portion 313 comprises one or more connection elements 314 for coupling the storage device 300 to the housing 100. In the exemplified embodiment, the one or more connection elements 314 comprises two protuberances 348 and two apertures 349 that are configured to receive a fastener 315. The apertures 349 extend through the plate portion 312 and the connection portion 313 of the connection plate 311. In other embodiments, the connection elements 314 may only comprise protuberances or apertures, but not both. The connection elements 314 and/or the fasteners 315 interact with an opening in the housing 100 (described below with reference to FIGS. 3, 8A, and 8B) to couple the storage device 300 to the housing 100.

The receptacle member 320 is attached to the connection plate 311 using mechanical coupling techniques, such as a snap-fit connection as shown in the exemplified embodiment. Specifically, in the exemplified embodiment the receptacle member 320 comprises a plurality of flexible mounting tabs 321 that are inserted into mounting apertures 316 of the connection plate 311 to couple the receptacle member 320 to the connection plate 311. Thus, the receptacle member 320 can be readily attached to and detached from the connection plate 311 in the exemplified embodiment. The receptacle member 320 is coupled to the front surface 323 of the plate portion 312 of the connection plate 311. As a result, the receptacle member 320 and the plate portion 312 of the connection plate 311 collectively define one or more of the first storage member 310. In the exemplified embodiment, the receptacle member 320 comprises a divider wall 347 so that the first storage member 310 comprises two compartments. However, the invention is not to be limited by this in all embodiments.

In some embodiments, mounting the storage device 300 to the housing 100 requires that the connection plate 311 be coupled to the housing 100 before the receptacle member 320 is attached to the connection plate 311 (because the receptacle member 320 blocks access to the connection elements 314 of the connection plate 311). For this reason, the receptacle member 320 and the connection plate 311 are formed as separate components in the exemplified embodiment. In other embodiments, the storage device 300 may be configured to be coupled to the housing 100 even with the receptacle member 320 coupled to the connection plate 311. In still other embodiments, the first storage member 310 may be a single unitary structure and it may be configured to be coupled to the housing 100 without detaching any component parts thereof.

In the exemplified embodiment, when the receptacle member 320 is attached to the connection plate 311, one or more compartments 325 are formed between the receptacle member 320 and the connection plate 311. In the exemplified embodiment, there are two of the compartments 325 separated from one another by the divider wall 347. However, the invention is not to be so limited in all embodiments and there could be a single compartment 325 or more than two compartments 325 in other embodiments.

The connection plate 311 has a first end 317 and a second end 318. The connection portion 313 is located on or extends from the connection plate 311 at the first end 317. The second end 318 of the connection plate 311 is configured to be coupled to the hinge 350. Specifically, the hinge 350 comprises a first end 351 that is coupled to the second end 318 of the connection plate 311 and a second end 352 that is coupled to the second storage member 330. The first end 351 of the hinge 350 comprises a pivot pin 353 that snap-fits into one or more pivot pin receiving apertures 319 at the second end 318 of the connection plate 311. Thus, the hinge 350 is configured to pivot or rotate relative to the first storage member 310 about a pivot axis P-P (shown in FIG. 4A).

The hinge 350 comprises a first portion 355 that comprises the first end 351, a second portion 356 that extends generally perpendicularly from the first portion 355, and a third portion 357 that extends generally perpendicularly from the second portion 356, the third portion 357 comprising the second end 352 of the hinge 350. The third portion 357 of the hinge 350 facilitates the coupling of the hinge 350 to the second storage member 330. The hinge 350 may have a generally "S" shaped curvature, although the invention is not to be limited by the shape of the hinge 350 in all embodiments.

In the exemplified embodiment, the second storage member 330 is a container that comprises a closed bottom end 331 and one or more sidewalls 332. The closed bottom end 331 and the one or more sidewalls 332 collectively define an interior cavity 335 of the second storage member 330. The sidewalls 332 extend to distal ends that define an open top end 333 of the interior cavity 335. The second storage member 330 extends along a storage member axis B-B from the closed bottom end 331 to the open top end 333. The second storage member 330 further comprises one or more divider walls 336 located in the interior cavity 335 to divide the interior cavity 335 into a plurality of compartments. In the exemplified embodiment, there are two of the divider walls 336 that divide the interior cavity 335 into three compartments 334. However, in other embodiments there may be no divider walls and just a single compartment, one divider wall and two compartments, or more than two divider walls and more than three compartments. Thus, the manner of dividing the interior cavity 335 into multiple compartments is not intended to be limiting of the present invention in all embodiments. In some embodiments, the second storage member 330 may comprise one or more compartments.

The second storage member 330 further comprises a slot 337 having a bottom opening in the closed bottom end 331 and a side opening 338 in one of the one or more sidewalls 332. The hinge 350 is coupled to the second storage member 330 via engagement between the third portion 357 of the hinge 350 and the slot 337 of the second storage member 330. Specifically, the third portion 357 of the hinge 350 nests within the slot 337 of the second storage member 330 to couple the second storage member 330 to the hinge 350.

Figure 7A:
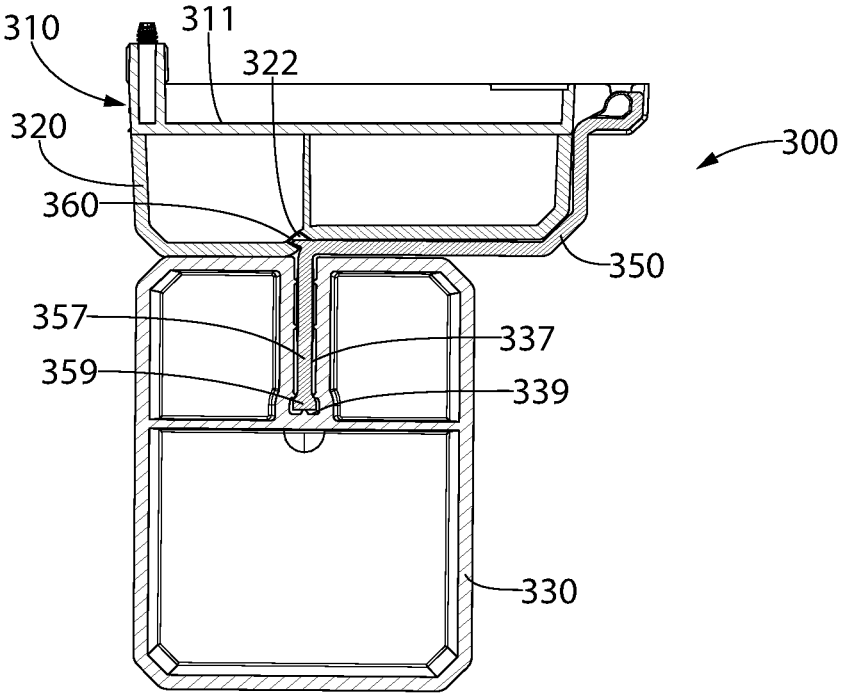
FIGS. 7A and 7B are cross-sectional views taken along line VII-VII of FIG. 4A and illustrating a locking mechanism of the storage device that facilitates locking the storage device in the first position.

Referring to FIG. 7A, the third portion 357 of the hinge 350 and the slot 337 have mating cross-sectional profiles that permit coupling and decoupling of the hinge 350 and the second storage member 330 only by moving the second storage member 330 relative to the third portion 357 of the hinge 350 in a direction parallel to the storage cavity axis B-B (which is also parallel to the pivot axis P-P in the exemplified embodiment). Specifically, in the exemplified embodiment the third portion 357 of the hinge 350 comprises a widened portion 359 that is wider than the rest of the third portion 357 of the hinge 350 and the slot 337 has a widened portion 339 that is wider than the rest of the slot 337. The widened portion 359 of the third portion 357 of the hinge 350 is located at the distal end of the third portion 357 of the hinge 350 and the widened portion 339 of the slot 337 is located at the distal end of the slot 337 (furthest from the side opening 338). The widened portion 359 of the third portion 357 of the hinge 350 has a cross-sectional profile that does not fit through the side opening 338 of the slot 337.

Thus, in the exemplified embodiment the third portion 357 of the hinge 350 can not be inserted into the slot 337 by inserting the widened portion 359 of the third portion 357 of the hinge 350 through the side opening 338. Instead, the third portion 357 of the hinge 350 can only be inserted into the slot 337 through the bottom opening. Similarly, decoupling the second storage member 330 from the hinge 350 requires moving the second storage member 330 in a direction parallel to the storage axis B-B relative to the hinge 350. This will prevent the second storage member 330 from being accidentally decoupled from the hinge 350 by requiring an intentional forceful action to achieve the decoupling.

Figure 6:
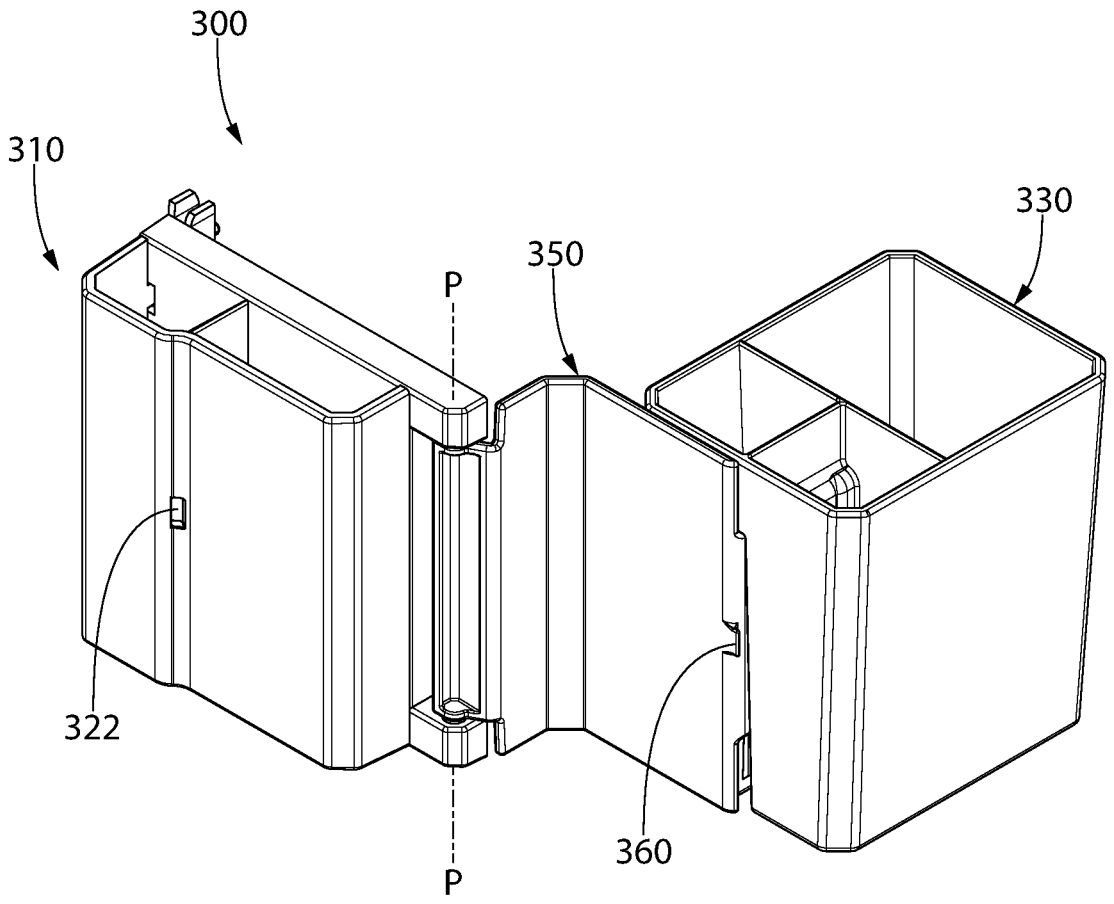
FIG. 6 is a perspective view of the storage device shown in FIG. 2, with the storage device in a second position.

Referring briefly to FIGS. 4A and 6, the storage device 300 is illustrated in two different states. Specifically, FIG. 4A illustrates the storage device 300 with the second storage member 330 in a first position and FIG. 6 illustrates the second storage member 330 in a second position. To move the second storage member 330 from the first position to the second position, the hinge 350 pivots or rotates about the pivot axis P-P. Because opposing ends of the hinge 350 are attached to the first and second storage members 310, 330, respectively, such pivoting of the hinge 350 causes the second storage member 330 to rotate away from the first storage member 310. The hinge 350 is rotatably coupled to the first storage member 310 and the second storage member 330 is fixedly (non-movably) coupled to the hinge 350. Thus, as the hinge 350 rotates relative to the first storage member 310, the second storage member 330 also rotates relative to the first storage member 310. The purpose of this rotation of the second storage member 330 relative to the first storage member 310 will be described in greater detail below with reference to FIGS. 9-11.

Referring again to FIGS. 7A and 7B, a locking feature of the storage device 300 that facilitates locking the second storage member 330 in the second state will be described. Specifically, in the exemplified embodiment the hinge 350 comprises a first locking member 360 and the first storage member 310 comprises a second locking member 322 that mates with the first locking member 360 of the hinge 350 when the second storage member 330 is in the first position to lock the second storage member 350 in the first position. In the exemplified embodiment, the first locking member 360 is a tab that protrudes from the hinge 350 and the second locking member 322 is an aperture, opening, slot, notch, or the like that is configured to receive the tab to lock the second storage member 350 in the first position. Of course, the first locking member 360 could comprise the opening, aperture, slot, notch or the like and the second locking member 322 could comprise the tab in other embodiments. Moreover, other features or components could be used as the locking members 322, 360 in other embodiments while achieving the same result.

In the exemplified embodiment, as the second storage member 330 is rotated/pivoted into the first position (i.e., moving from the position of FIG. 7B to the position of FIG. 7A), the first locking member 360 (i.e., the tab) interacts/mates with the second locking member 322 (i.e., the opening). Once in the first position, a user will have to apply a sufficient force in order to pull the first locking member 360 out of engagement with the second locking member 322 in order to alter the second storage member 330 from the first position (FIG. 4A) to the second position (FIG. 6). Although in the exemplified embodiment the first locking member 360 is located on or forms a part of the hinge 350, the invention is not to be so limited in all embodiments. Specifically, in other embodiments the first locking member 360 may be located on the second storage member 330 rather than on the hinge 350 while still achieving the same result.

Figure 7B:
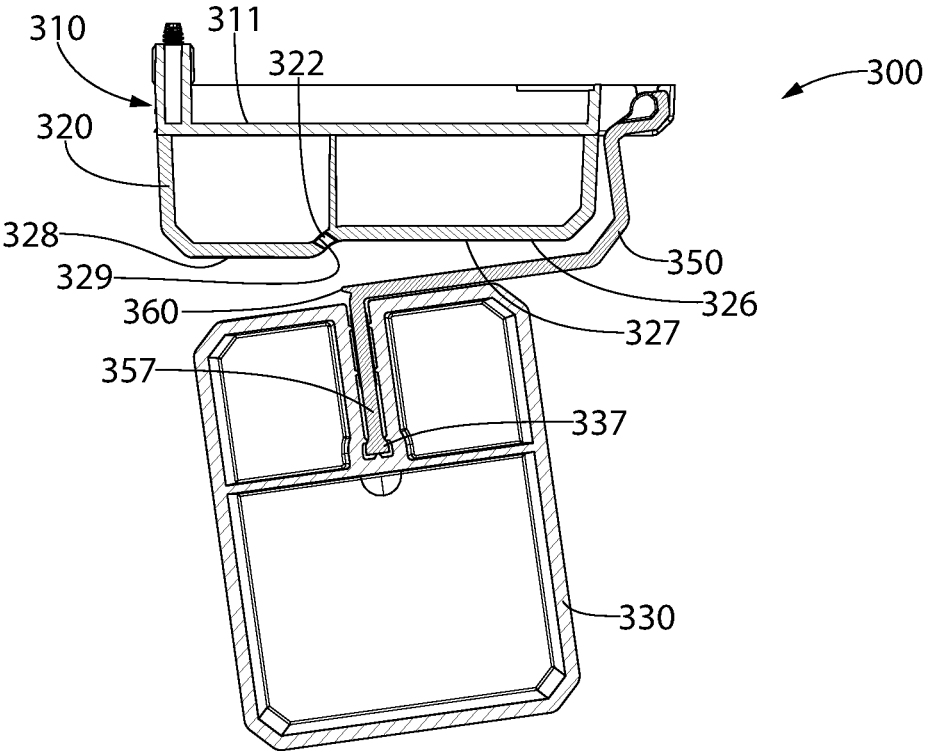

Still referring to FIGS. 7A and 7B, the first storage member 310 comprises an outer surface 326. The outer surface 326 comprises a first portion 327 and a second portion 328, the first portion 327 being recessed relative to the second portion 328. Thus, the second portion 328 of the outer surface 326 extends beyond the first portion 327 of the outer surface 326. When the second storage member 330 is in the first position (which it is in FIG. 7A), the hinge 350 wraps around a portion of the outer surface 326 of the second storage member 330. More specifically, the hinge 350 abuts against the first portion 327 (i.e., the recessed portion) of the outer surface 326 of the first storage member 310 and a portion of an outer surface of the second storage member 330 abuts the second portion 328 of the outer surface 326 of the first storage member 310. This creates a nice, tight fit between the various components of the storage device 300 so that it has a small profile and footprint and can fit readily inside of the cavity 110 of the housing 100 of the cabinet 1000.

In the exemplified embodiment, the second locking member 322 is located at the junction between the first and second portions 327, 328 of the outer surface 326 of the first storage member 310. Specifically, the outer surface 326 of the first storage member 310 comprises a transition region 329 between the first and second portions 327, 328, and the second locking member 322 is located along the transition region 329. The invention is not to be so limited in all embodiments and the second locking member 322 could alternatively be located along one of the first and second portions 327, 328 of the outer surface 326 of the first storage member 310 in other embodiments.

Referring to FIGS. 3 and 8A-8C, the coupling of the storage device 300 to the housing 100 of the cabinet 1000 will be described. In the exemplified embodiment, the right sidewall 103 of the housing 100 comprises a channel 120 extending vertically within the cavity 110. In the exemplified embodiment, the channel 120 is formed into the right sidewall 103 adjacent to the rear wall 101. Furthermore, the housing 100 comprises a plurality of apertures 121 forming openings through the right sidewall 103, with each of the plurality of apertures 121 being located within the channel 120. The left sidewall 102 may also have a channel 129 and apertures so that the storage device 300 can be coupled to either of the left or right sidewalls 102, 103 of the housing 100. Furthermore, the top and bottom sidewalls 104, 105 and/or the inner surface 201 of the door 200 may have similar features that enable the storage device 300 to be coupled thereto in some embodiments.

To couple the storage device 300 to the housing 100, the connection portion 313 of the connection plate 311 of the first storage member 310 is inserted into the channel 120 of the housing 100. The connection plate 311 is continued to be moved towards the right sidewall 103 (or the left sidewall 102 if the storage device 300 is being coupled to the left sidewall 102, etc.) until the connection elements 314 (i.e., protuberances) extend into and through the apertures 121 in the channel 120. The connection elements 314 may fit within the apertures 121 in an interference or press-type fit so that the connection elements 314 themselves are sufficient to couple the storage device 300 to the housing 100.

In some embodiments, the fasteners 315 may also be used to further securely couple the storage device 300 to the housing 100. In such embodiments, at the time of initial coupling of the storage device 300 to the housing 100, the storage device 300 may be disassembled (i.e., broken down into the parts shown in FIG. 5). Thus, first the connection plate 311 will be coupled to the housing 100 by inserting the protuberances 348 of the connection elements 314 through the apertures 121 in the channel 120. Next, the fasteners 315 will be passed through the apertures 349 of the connection elements 314 and into the apertures 121 in the channel 120 to further secure the storage device 300 to the housing 100. Next, the receptacle member 320 can be coupled to the connection plate 311, and then the hinge 350 can be coupled to the connection plate 311. Finally, the second storage member 330 can be coupled to the hinge 350 to form the fully assembled storage device 300. In either case, the connection plate 311 of the first storage member 310 is coupled directly to the inner surface of one of the sidewalls (i.e., the inner surface 107, 108 of the first or second sidewalls 102, 103, for example) of the housing 100. Thus, the first storage member 310 is fixedly coupled directly to one of the plurality of sidewalls of the housing 100. As a result of this coupling technique, the first storage member 310 is fixedly (i.e., non-movably) coupled to the housing 100 and the second storage member 330 is pivotably/rotatably coupled to the first storage member 310 by way of the hinge 350. The second storage member 330 is then also pivotable/rotatable relative to the housing 100 due to the coupling between the first storage member 310 and the housing 100.

As mentioned previously, the location along the left or right sidewall 102, 103 (or the top or bottom sidewall 104, 105) at which the storage device 300 is coupled to the housing 100 is not a fixed location and it may be modified. Thus, the user can attach the storage device 300 to the housing 100 at any location along the length of the sidewall to which it is being attached. FIG. 8C is an example of this, illustrating the storage device 300 coupled to the right sidewall 103 at a higher elevation than in FIG. 8B. The storage device 300 could be coupled to the right sidewall 103 (or the left sidewall 102 or any of the other sidewalls) at any location, such as between the lower shelf 190 and the bottom sidewall 105, between the two shelves 190, between the top shelf 190 and the top sidewall 104, along the top or bottom sidewalls 104, 105 at varying distances from the left and right sidewalls 102, 103, etc. Thus, depending on user need, the storage device 300 can be attached to the housing 100 at a desired location and there is no set location at which the storage device 300 must be attached to the housing 100.

Furthermore, although a particular technique including structure is disclosed herein for coupling the storage device 300 to the housing 100, the invention is not to be so limited in all embodiments. In some embodiments, the housing 100 may not have the channel 120, but may still include apertures for receiving connection elements of the storage device 300. In other embodiments, the storage device 300 may include apertures that receive protuberances extending from the inner surfaces of the sidewalls 102, 103, 104, 105 of the housing 100. In still other embodiments, other coupling techniques may be used including the use of hook-and-loop fasteners, bolts, interference fit, snap fit, adhesive, magnets, or the like. Thus, the manner in which the storage device 300 is coupled to the housing 100 is not limiting of the present invention in all embodiments. In some embodiments, it is merely preferable that the storage device 300 is coupled to the inner surface of one of the sidewalls 102, 103, 104, 105 of the housing 100 without being limited to a particular structure or configuration for achieving the coupling.

Thus, as has been described herein, the storage device 300 is coupled to the inner surface of one of the plurality of sidewalls 102, 103, 104, 105. In the exemplified embodiment, the storage device 300 is coupled to the inner surface 108 of the right sidewall 103, but it could also be coupled to the inner surface 107 of the left sidewall 102 or the inner surfaces 109, 111 of one of the top and/or bottom sidewalls 104, 105. In still other embodiments, the storage device 300 could be coupled to the front surface 112 of the rear wall 101 or to the inner surface 201 of the door. However, in the exemplified embodiment no portion of the storage device 300 is coupled directly to the frame 114, and particularly to the front surface 115 of the frame 114. Rather, the storage device 300 is only coupled to the inner surfaces of the sidewalls or the inner surface 201 of the door 200 which define and/or otherwise bound the cavity 110 of the housing 100.

Referring to FIGS. 1, 2, 9, and 10, the various states of the door 200 and the various positions of the storage device 300 will be described. FIG. 1 illustrates the cabinet 1000 with the door 200 in the closed state and the second storage member 330 of the storage device 300 in the first position (although the storage device 300 is not shown in FIG. 1 because the cavity 110 is hidden from view due to the door 200 being closed, but it is shown in the sectional view of FIG. 3). FIG. 2 illustrates the cabinet 1000 with the door 200 in the open state and the second storage member 330 of the storage device 300 in the first position. Thus, the door 200 is open so the front opening 106 of the cavity 110 is exposed, and as such the storage device 300 and the shelves 190 are visible. With the door 200 open, a user can put items into and remove items from the cavity 110. When the second storage member 330 is in the first position, the first storage member 310, the second storage member 330, and the hinge 350 are located entirely within the cavity 110 of the housing 100. Thus, when the second storage member 330 is in the first position, no portion of the storage device 300 protrudes from or extends beyond the front opening 106 of the cavity 110 of the housing 100.

Figure 9:
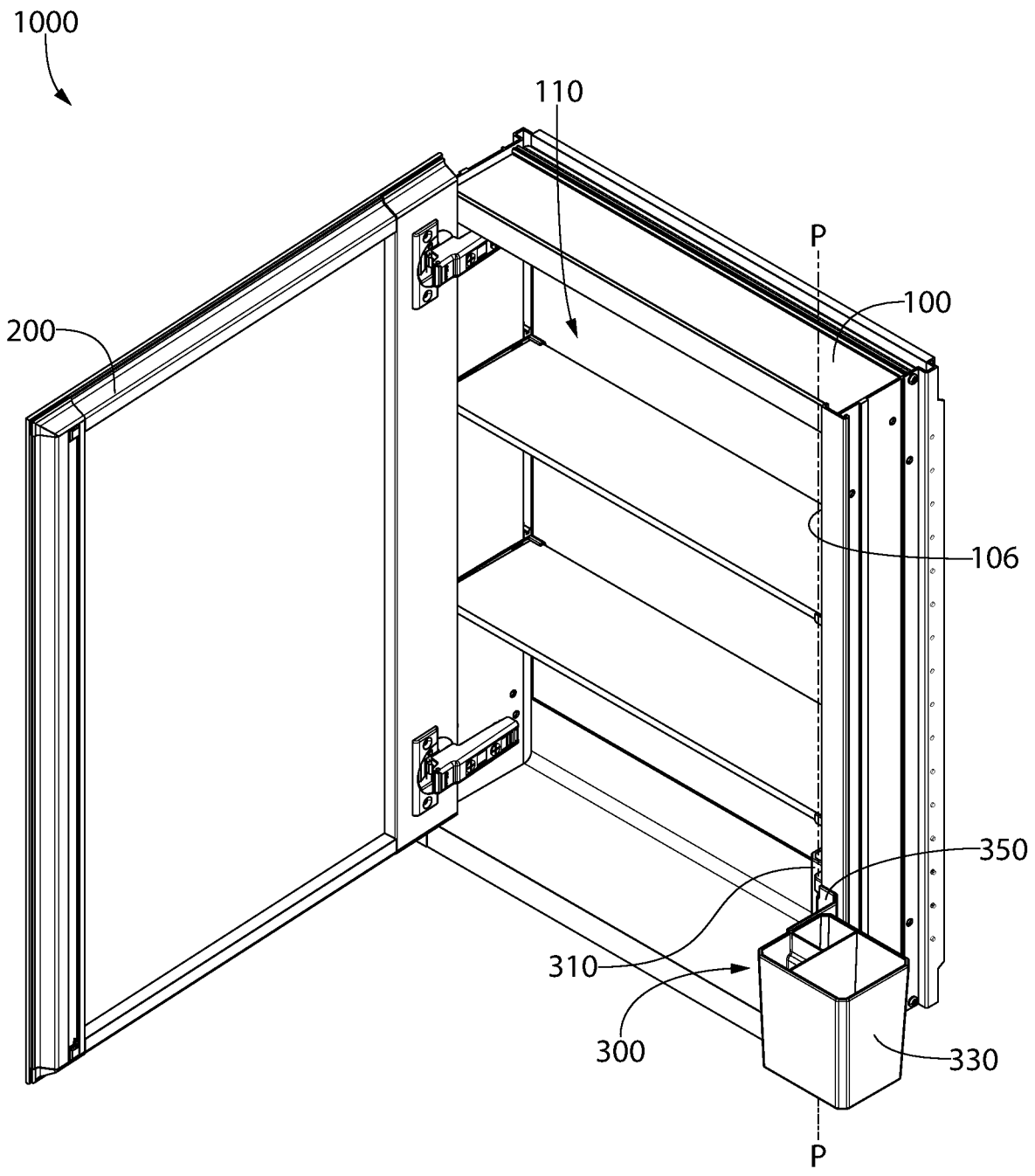
FIG. 9 is a perspective view of the cabinet of FIGS. 1 and 2 with the door in the open state and the storage device in the second position.

FIG. 9 illustrates the cabinet 1000 with the door 200 in the open state and the second storage member 330 of the storage device 300 in the second position. Specifically, to move from FIG. 2 to FIG. 9, the hinge 350 is pivoted about the pivot axis P-P, which moves the second storage member 330 from the first position to the second position. As the second storage member 330 moves in this manner, the first storage member 310 remains fixed to the housing 100 and does not move. Thus, when the second storage member 330 of the storage device 300 is in the second position, the first storage member 310 is located in the cavity 110 of the housing 100 and the second storage member 330 is located outside of the cavity 110 of the housing 100.

Figure 10:
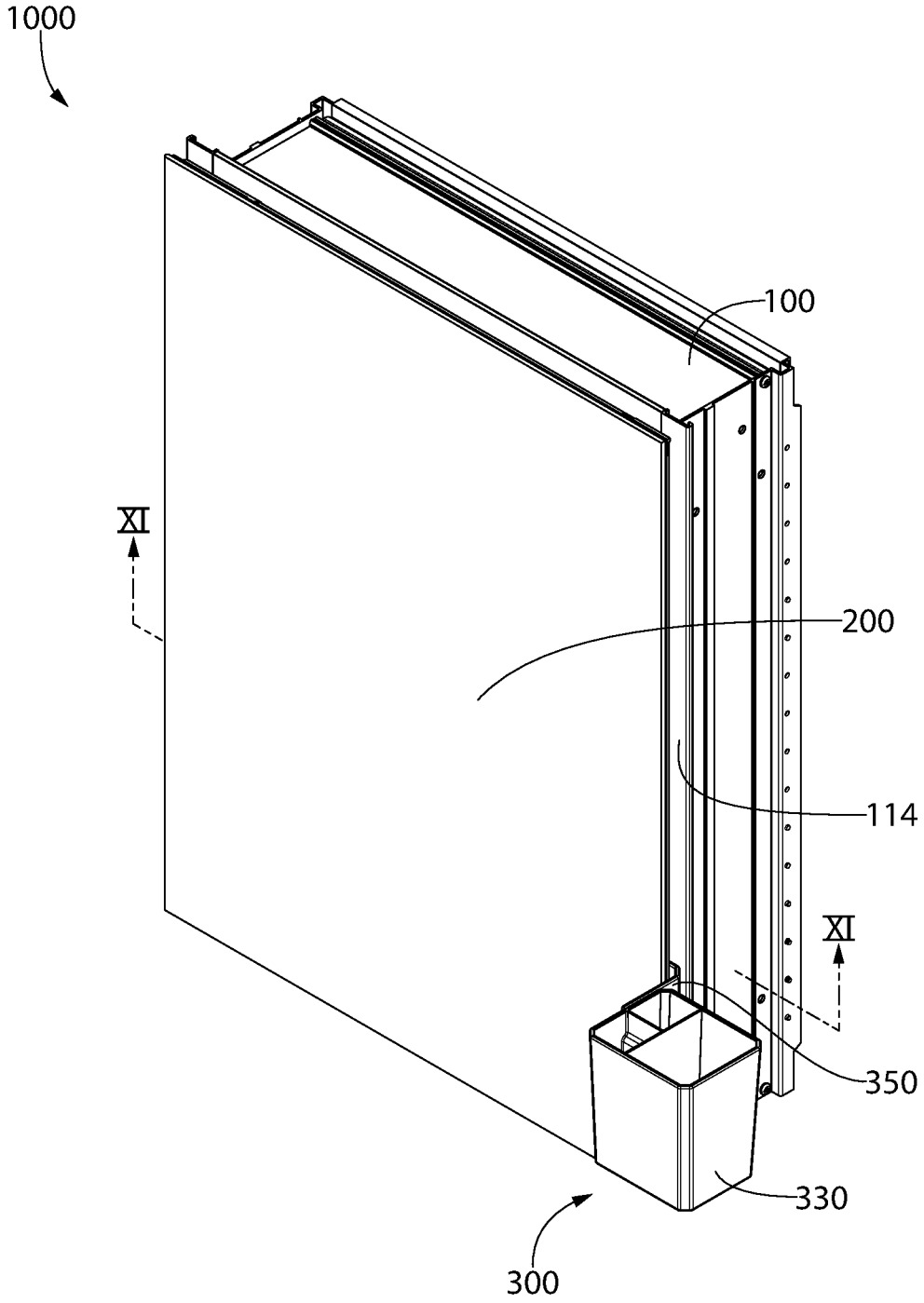
FIG. 10 is a perspective view of the cabinet of FIG. 9 with the door in the closed state and the storage device in the second position.

Finally, FIG. 10 illustrates the cabinet 1000 with the door 200 in the closed state and the second storage member 330 of the storage device 300 in the second position. Thus, the door 200 can be altered from the open state to the closed state even while the second storage member 330 of the storage device 300 is in the second position and located outside of the cavity 110 of the housing 100. When the door 200 is so altered, the door 200 simply closes over the portion of the hinge 350 which extends along the gap between the door 200 and the frame 114 of the housing 100. It should be appreciated that the door 200 can be altered from the open state to the closed state when the second storage member 330 is in either of the first or second positions.

Thus, the second storage member 330 may remain outside of the housing 100 so that a user can use it to store items while the user can use the front surface 202 of the door 200 as a mirror, without requiring the user to continually open and close the door 200 to gain access to some items. In some embodiments, a user may use the second storage member 330 to store his/her personal electronic devices such as a cellular phone or a smart phone in order to keep those items off of the countertop which could become wet and damage the electronic device. Of course, any other item may be stored in the second storage member 330 as may be desired so long as it fits therein. The size and shape of the second storage member 330 could also be modified from that which is depicted in the drawings to accommodate different items that a user may desire to store therein.

Figure 11:
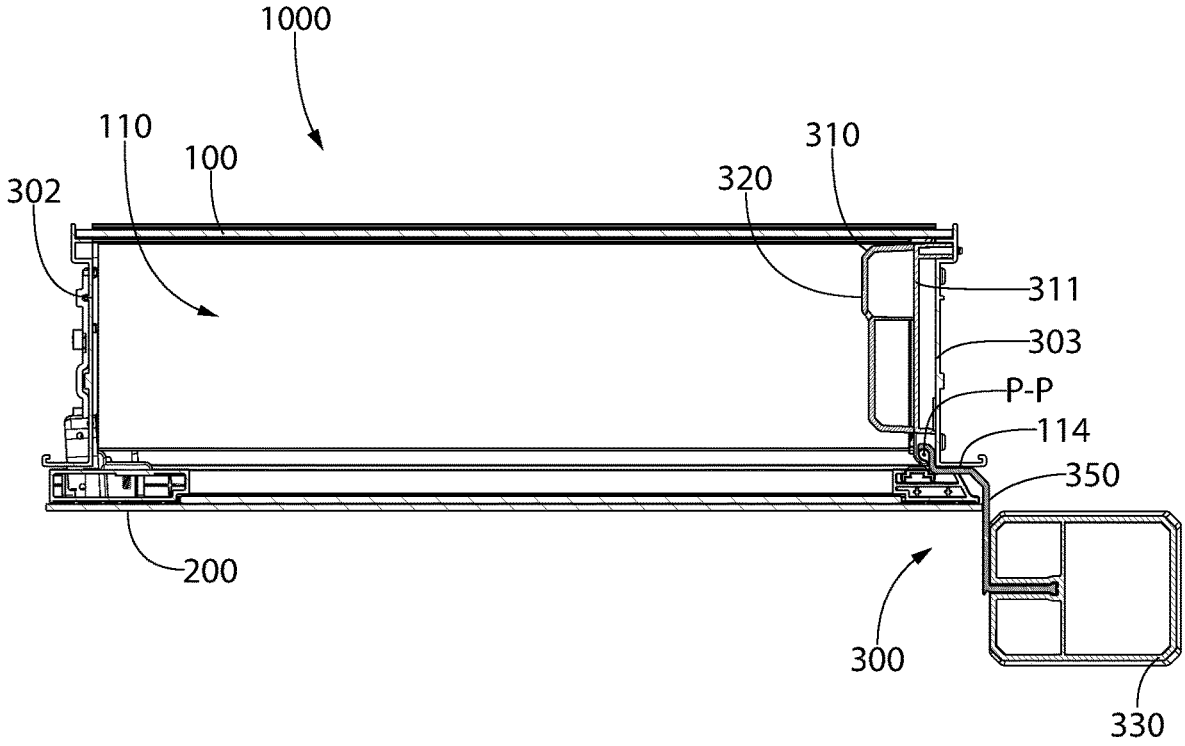
FIG. 11 is a cross-sectional view taken along line XI-XI of FIG. 10.

Referring to FIGS. 10 and 11, the cabinet 1000 will be further described with the door 200 in the closed state and the second storage member 330 of the storage device 300 in the second position located outside of the cavity 110 of the housing 100. As noted previously, the second storage member 330 is movable between the first and second positions by rotating or pivoting the hinge 350 about the pivot axis P-P. In the exemplified embodiment, the portion of the pivot axis P-P that is aligned with the storage device 300 is located inside of the cavity 110 of the housing 100. The pivot axis P-P does not move, so it is always at least partially located inside of the cavity 110 of the housing 100.

Furthermore, when the second storage member 330 of the storage device 300 is in the second position, a first portion of the hinge 350 is located inside of the cavity 110 and a second portion of the hinge 350 is located outside of the cavity. Furthermore, with the door 200 in the closed state and the second storage member 330 in the second position, a third portion of the hinge 350 passes through a gap between the door 200 and the frame 114 of the housing 100.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A cabinet comprising:

a housing comprising a rear wall and a plurality of sidewalls extending from the rear wall to define a cavity having a front opening;

a storage device coupled to one of the plurality of sidewalls of the housing, the storage device comprising:

a first storage member fixedly coupled directly to the one of the plurality of sidewalls of the housing and located within the cavity of the housing, the first storage member comprising:

one or more compartments;

a connection plate that is coupled directly to the one of the plurality of sidewalls of the housing, the connection plate comprising a front surface, a rear surface, a first end, a second end, and one or more connection elements protruding from the rear surface along the first end; and a receptacle member detachably coupled to the connection plate, the connection plate and the receptacle member collectively defining the one or more compartments of the first storage member; and a second storage member pivotably coupled to the first storage member between a first position whereby the second storage member is located within the cavity of the housing and a second position whereby the second storage member is located outside of the cavity of the housing.

2. The cabinet according to claim 1 further comprising a hinge that is coupled to the second end of the connection plate of the first storage member and to the second storage member for pivotably moving the second storage member relative to the first storage member.

3. The cabinet according to claim 2 wherein the receptacle member comprises an outer surface comprising a first portion and a second portion, the first potion being recessed relative to the second portion, and wherein when the second storage member is in the first position the hinge abuts the first portion of the outer surface of the receptacle member and the second storage member abuts at least a portion of the second portion of the outer surface of the receptacle member.

4. The cabinet according to claim 3 wherein the outer surface of the receptacle member comprises a transition region between the first and second portions, and the receptacle member comprising a first locking member located along the transition region, and wherein the hinge comprises a second locking member that engages the first locking member of the receptacle member when the second storage member is in the first position to prevent the second storage member from transitioning from the first position to the second position without user applied force onto the second storage member.

5. The cabinet according to claim 1 wherein the second storage member is a container comprising a closed bottom end and one or more sidewalls extending from the closed bottom end to a distal end of the container, the closed bottom end and the one or more sidewalls collectively defining an interior cavity of the second storage member.

6. The cabinet according to claim 5 wherein the second storage member comprises one or more divider walls located in the interior cavity to divide the interior cavity into a plurality of compartments.

7. The cabinet according to claim 5 wherein the second storage member comprises an outer surface having a slot, and further comprising a hinge comprising a first portion that is coupled to the first storage member and a second portion that nests within the slot of the second storage member to couple the hinge to the second storage member, wherein the hinge facilitates pivoting of the second storage member relative to the first storage member.

8. The cabinet according to claim 1 further comprising a door coupled to the housing and alterable between: (1) an open state whereby the front opening of the cavity is exposed to provide access to the cavity; and (2) a closed state whereby the door closes the front opening of the cavity, wherein the door is able to be altered into the closed state when the second storage member is in either of the first or second positions.

9. The cabinet according to claim 8 wherein the first and second storage members are pivotably coupled together by a hinge, and wherein when the second storage member is in the second position and the door is in the closed state a portion of the hinge is positioned between an inner surface of the door and a front face of the housing.

10. The cabinet according to claim 1 wherein the first and second storage members are pivotably coupled together by a hinge, and wherein the hinge pivots about a vertical pivot axis, and wherein a portion of the vertical pivot axis that is aligned with the housing is located within the cavity of the housing.

11. The cabinet according to claim 1 wherein the storage device is configured to be coupled to the one of the plurality of sidewalls at a plurality of different elevations along the housing such that a height of the storage device is adjustable.

12. A cabinet comprising:

a housing comprising a cavity having a front opening;

a storage device coupled to the housing, the storage device comprising a first storage member that is fixed to the housing and a second storage member that is movable relative to the first storage member between: (1) a first position whereby the first and second storage members of the storage device are located within the cavity of the housing; and (2) a second position whereby the first storage member is located within the cavity of the housing and the second storage member is located outside of the cavity of the housing the second storage member comprising a container having a closed bottom end and one or more sidewalls extending from the closed bottom end to an open top end, the closed bottom end and the one or more sidewalls collectively defining an interior cavity of the second storage member; and wherein the first storage member of the storage device comprises a connection plate comprising one or more connection elements for coupling the storage device to the housing and a receptacle member coupled to the connection plate, wherein one or more compartments are defined between the connection plate and the receptacle member.

13. The cabinet according to claim 12 further comprising a hinge coupled to the first and second storage members for moving the second storage member relative to the first storage member between the first and second positions.

14. A cabinet comprising:

a housing comprising a cavity having a front opening;

a storage device coupled to the housing, the storage device comprising a first storage member comprising one or more compartments and a second storage member comprising an interior cavity, the first storage member being fixed to the housing so that the first storage member is non-movable relative to the housing, the second storage member being pivotable relative to the first storage member between: (1) a first position whereby the second storage member is located within the cavity of the housing; and (2) a second position whereby the second storage member is located outside of the cavity of the housing;

wherein the first storage member of the storage device comprises:

a connection plate having a front surface, a rear surface, a first end, and a second end, the connection plate comprising one or more connection elements extending from the rear surface along the first end for coupling the storage device to the housing; and a receptacle member that is coupled to the connection plate, the front surface of the connection plate and an inner surface of the receptacle member defining the one or more compartments of the first storage member; and a hinge comprising a first portion that is coupled to the second end of the connection plate, a third portion that is coupled to the second storage member, and a second portion extending between the first and second portions.

15. The cabinet according to claim 14 wherein the second storage member comprises an outer surface having a slot, and wherein the second portion of the hinge nests within the slot of the second storage member to couple the hinge to the second storage member.

16. The cabinet according to claim 14 wherein the storage device is configured to be detachably coupled to the housing at a plurality of different elevations.

* * * * *